US006295981B1

(12) United States Patent
Beal et al.

(10) Patent No.: US 6,295,981 B1
(45) Date of Patent: Oct. 2, 2001

(54) FIREPLACE WITH VERTICAL OR HORIZONTAL VENTING

(75) Inventors: Thomas J. Beal, Ossian; Michael G. Catenazzo, Van Buren, both of IN (US)

(73) Assignee: CFM Majestic Inc., Missisauga (CA)

( * ) Notice: Subject to any disclaimer, the term of this patent is extended or adjusted under 35 U.S.C. 154(b) by 0 days.

(21) Appl. No.: 09/483,380

(22) Filed: Jan. 12, 2000

Related U.S. Application Data

(60) Provisional application No. 60/115,777, filed on Jan. 13, 1999.

(51) Int. Cl.[7] ..... F24B 1/189

(52) U.S. Cl. ..... 126/512; 126/515; 126/85 B

(58) Field of Search ..... 126/85 B, 307 R, 126/512, 515, 531

(56) References Cited

U.S. PATENT DOCUMENTS

| | | | |
|---|---|---|---|
| 3,906,925 | | 9/1975 | Dyer . |
| 4,112,913 | | 9/1978 | Shimek et al. . |
| 4,408,594 | | 10/1983 | Shimek et al. . |
| 4,424,792 | | 1/1984 | Shimek et al. . |
| 4,793,322 | | 12/1988 | Shimek et al. . |
| 4,852,548 | | 8/1989 | Shimek et al. . |
| 4,875,464 | | 10/1989 | Shimek et al. . |
| 4,909,227 | | 3/1990 | Rieger ..... 126/531 |
| 5,000,162 | | 3/1991 | Shimek et al. . |
| 5,016,609 | | 5/1991 | Shimek et al. . |
| 5,076,254 | | 12/1991 | Shimek et al. . |
| 5,114,336 | | 5/1992 | Karabin et al. . |
| 5,191,877 | | 3/1993 | Shimek et al. . |
| 5,218,953 | | 6/1993 | Shimek et al. . |
| 5,256,266 | | 10/1993 | Blanchette et al. . |
| 5,263,471 | | 11/1993 | Shimek et al. . |
| 5,267,552 | | 12/1993 | Squires et al. . |
| 5,320,086 | | 6/1994 | Beal et al. . |
| 5,347,983 | | 9/1994 | Shimek . |
| 5,392,760 | | 2/1995 | Binzer . |
| 5,398,669 | | 3/1995 | McCullough et al. . |
| 5,419,916 | | 5/1995 | Yamamoto et al. . |
| 5,421,774 | * | 6/1995 | Specht ..... 126/307 R |
| 5,429,495 | | 7/1995 | Shimek et al. . |
| 5,452,708 | | 9/1995 | Shimek et al. . |
| 5,479,916 | | 1/1996 | Shimek et al. . |
| 5,482,028 | | 1/1996 | Binzer . |
| 5,601,073 | | 2/1997 | Shimek et al. . |
| 5,603,312 | * | 2/1997 | Champion et al. ..... 126/531 |
| 5,647,340 | | 7/1997 | Shimek et al. . |
| 5,647,342 | | 7/1997 | Jamieson et al. . |
| 5,688,568 | | 11/1997 | Wolf et al. . |
| 5,737,888 | | 4/1998 | Shimek et al. . |
| 5,775,408 | | 7/1998 | Shimek et al. . |
| 5,941,231 | * | 8/1999 | Garrett et al. ..... 126/512 |
| 6,029,655 | * | 2/2000 | Hussong et al. ..... 126/515 |

* cited by examiner

*Primary Examiner*—Sara Clarke
(74) *Attorney, Agent, or Firm*—Baniak Pine & Gannon

(57) ABSTRACT

A fireplace adapted for attachment to a flue pipe assembly including an exhaust pipe and a surrounding fresh air pipe is provided. The fireplace comprises an interior housing. The interior housing forms a combustion chamber. The fireplace also comprises a top wall, a rear wall and side walls. These walls define an exterior housing about the combustion chamber. A combustion air flowpath is defined within the housing through which air for combustion is brought from outside the housing into the combustion chamber. The fireplace also comprises a top port formed in the top wall and a rear port formed in the rear wall. Each of the top and rear ports include a first portion that communicates with the combustion chamber and a second portion that communicates with the combustion air flowpath. Finally, the fireplace comprises a vent pipe assembly. The vent pipe assembly includes an inlet air pipe member and an outlet air pipe member. The outlet air pipe member is connectable with the selected port at the first portion. The inlet air pipe member is connectable with the selected port at the second portion. The inlet air pipe member further includes a plate portion which overlies and closes an unselected port. The vent pipe assembly is non-integral with the housing and is movable between the top port and the rear port.

20 Claims, 3 Drawing Sheets

FIREPLACE WITH VERTICAL OR HORIZONTAL VENTING

RELATED APPLICATIONS

This Application claims the benefit of U.S. Provisional Application 60/115,777, filed on Jan. 13, 1999.

BACKGROUND OF THE INVENTION

1. Field of the Invention

The present invention relates to fireplaces and, in particular, to direct vent gas fireplaces.

2. Description of the Related Art

Gas fireplaces of conventional design typically utilize a source of combustion air from the room being heated. This lowers the efficiency of the gas fireplace because a portion of the heated air in the room is drawn into the combustion chamber and exhausted up the chimney. It is known to provide separate ducting from the outside ambient environment to the combustion chamber to increase the efficiency of the fireplace. The ducted air provides a source of oxygen for combustion in the combustion chamber and decreases the amount of air from the room being heated which is exhausted up the chimney. Such ducting, however, requires additional materials and labor to install.

It is also known in the art to utilize concentric flue pipes to exhaust combustion products to the outside environment and supply combustion air from the outside environment. Such fireplaces are termed "direct vent" fireplaces and are disclosed, for example, in U.S. Pat. Nos. 4,793,322 (Shimek I) and U.S. Pat. No. 4,909,227 (Rieger). A direct vent fireplace has the advantage of utilizing a common concentric flue pipe assembly to both exhaust combustion products from and supply combustion air to the combustion chamber. Moreover, only a single opening need be cut through an exterior wall of a house to accommodate the concentric flue pipe assembly.

In general, a direct vent fireplace has a first pipe with a diameter larger than and disposed concentrically around a second pipe. The duct formed by the second pipe is used to convey exhaust products from the combustion chamber to the outside environment. The annular space formed between the first and second pipes defines a fresh air conduit through which combustion air flows from the outside ambient environment into the combustion chamber.

A problem with direct vent gas fireplaces is that the concentric flue pipe assembly cannot be easily vented in both a horizontal or vertical direction. Shimek I and Rieger disclose direct vent fireplaces which respectively connect the concentric flue to the rear wall and top wall of the fireplace. A concentric flue attached to the rear wall of the fireplace may be easily extended through an adjacent sidewall of the house. However, if it is desirable to exhaust the concentric flue in a vertical direction, the fireplace must be moved forward a sufficient distance to allow coupling of a right angle concentric pipe elbow. Thus, additional floor space is required to accommodate the projected footprint of the fireplace and concentric flue pipe assembly.

A concentric flue pipe assembly attached to the top of a direct vent fireplace has a similar problem when it is desired to vent the concentric flue in a horizontal direction (see, e.g., Rieger at Col. 1, lines 23–32). That is, the fireplace must be moved forward a sufficient distance to allow coupling of a right angle concentric pipe elbow.

Because of two possible installation configurations, i.e., vertical or horizontal venting of the concentric flue pipe assembly, it is necessary with conventional direct vent fireplace to provide two totally different configurations. That is, for relatively close placement of the fireplace adjacent the outside wall of the house, it is necessary to provide one configuration allowing attachment of the concentric flue pipe assembly to the back of the fireplace for horizontal venting, and a second configuration allowing attachment of the concentric flue pipe assembly to the top of the fireplace for vertical venting. The necessity to provide two different configurations increases inventory requirements at the factory. Reference can be made, for instance, to U.S. Pat. No. 5,320,086 (Shimek II) regarding the same. Shimek II is directed to a single fireplace construction that could be used in both a vertical venting configuration (i.e., relatively straight upwardly from the fireplace) or a horizontal venting configuration (i.e., relatively straight out from the back of the fireplace).

Moreover, such fireplaces should be equipped with a mechanism or process that enables one type of venting (e.g., vertical), while preventing the other type of venting (e.g., horizontal). This would allow any exhaust matter to escape the fireplace via the selected venting type, while preventing the same from escaping via the non-selected type.

Accordingly, it would be desirable to have a fireplace that overcomes the above disadvantages.

SUMMARY OF THE INVENTION

The present invention provides a direct vent gas fireplace which can be adapted for either a vertical or horizontal venting configuration by simply attaching a separate vent pipe assembly to one or the other of two ports in the fireplace. The vent pipe assembly further serves to close the unselected port. This has the advantage, for instance, of allowing an installer to choose which type of venting configuration is needed on site.

In one embodiment thereof, a fireplace adapted for attachment to a flue pipe assembly including an exhaust pipe and a surrounding fresh air pipe is provided. The fireplace comprises an interior housing. The interior housing forms a combustion chamber. The fireplace also comprises a top wall, a rear wall and sidewalls. These walls define an exterior housing about the combustion chamber. A combustion air flowpath is defined with the housing through which air for combustion is brought from outside the housing into the combustion chamber. The fireplace also comprises a top port formed in the top wall and a rear port formed in the rear wall. Each of the top and rear ports include one portion communicating with the combustion chamber and another portion communicating with the combustion air flowpath. Finally, the fireplace comprises a vent pipe assembly. The vent pipe assembly includes an inlet air pipe member and an outlet air pipe member. The outlet air pipe member is connectable with a selected port at the portion communicating with the combustion chamber. The inlet air pipe member is connectable with a selected port at the portion communicating with the combustion air flowpath. The inlet air pipe member further includes a plate portion which overlies and closes an unselected port. The vent pipe assembly is non-integral with the housing and is movable between the top port and the rear port.

An advantage of the present invention is that the fireplace may be easily vented in either a horizontal or vertical direction.

A further advantage is that the fireplace may be selectively vented in either a horizontal or vertical direction utilizing the same fireplace components.

A further advantage is that the fireplace will allow venting in the selected direction, while at the same time prevent venting in the non-selected direction.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE PRESENTLY PREFERRED EMBODIMENTS

Figure 1:
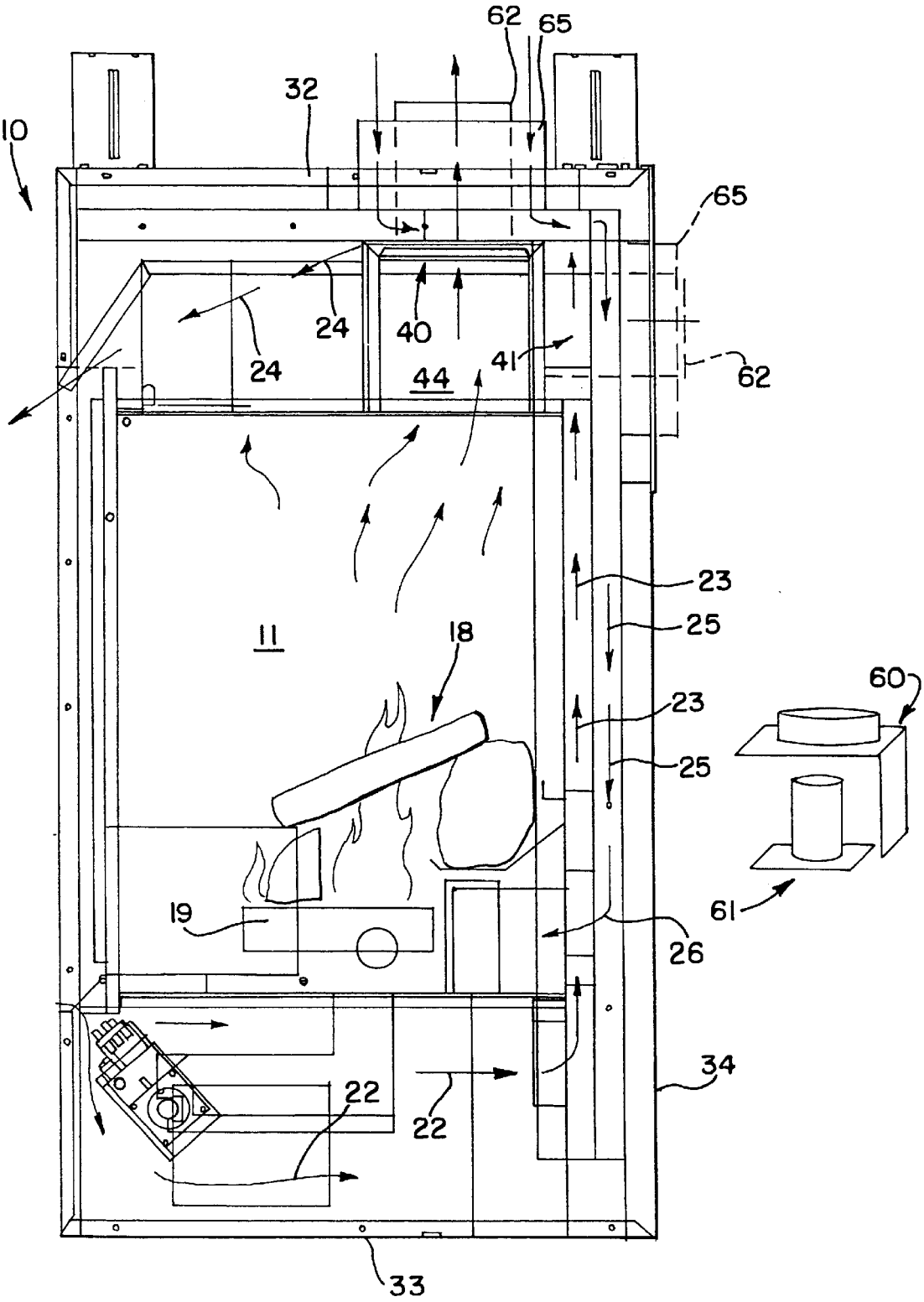
FIG. 1 is a schematic side view of a cross section of one embodiment of a fireplace, made in accordance with the present invention.
Figure 2:
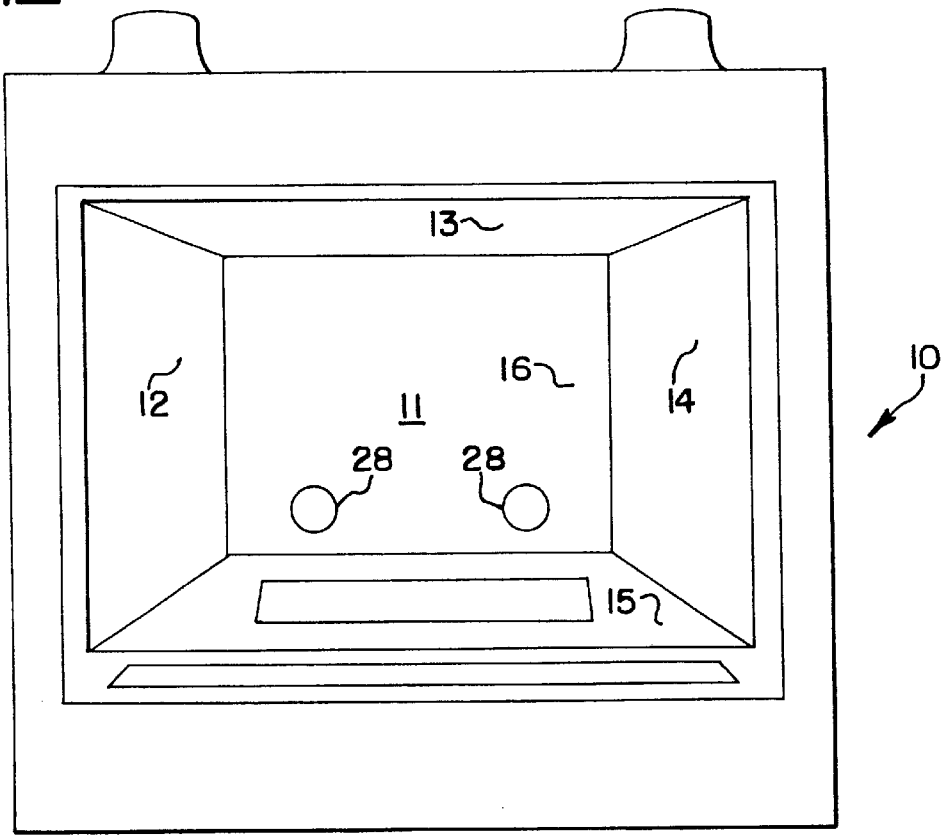
FIG. 2 is a front view of the fireplace of FIG. 1, with the logs and the vent pipe assembly removed.
Figure 3:
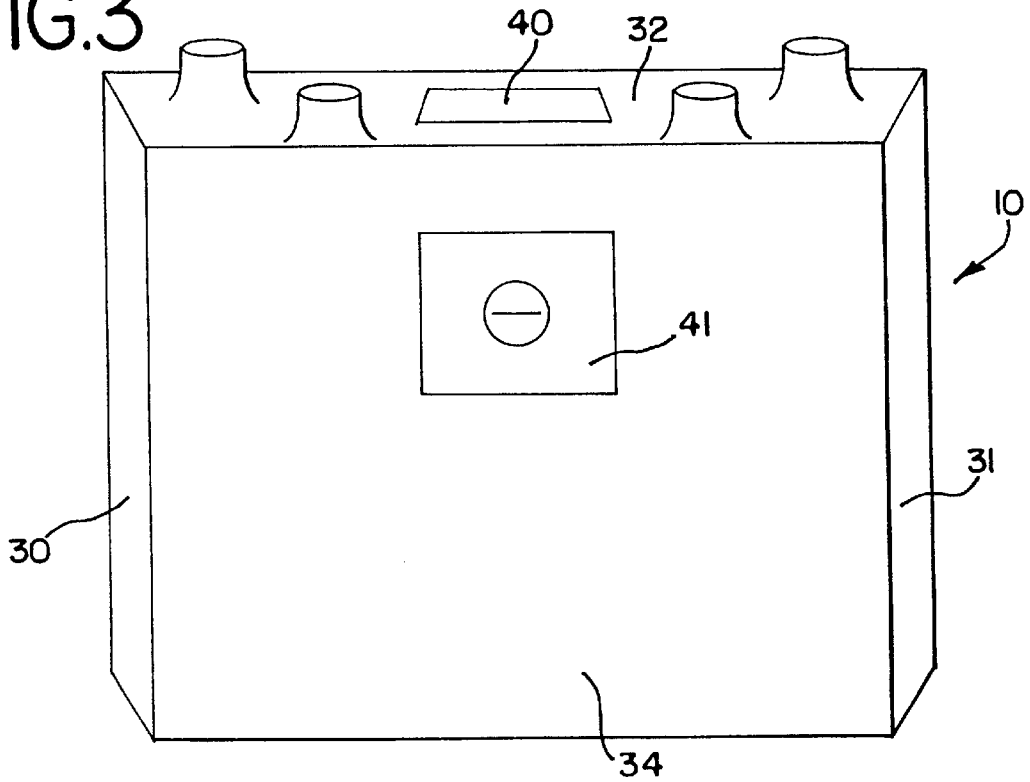
FIG. 3 is a back view of the fireplace of FIG. 2.
Figure 4:
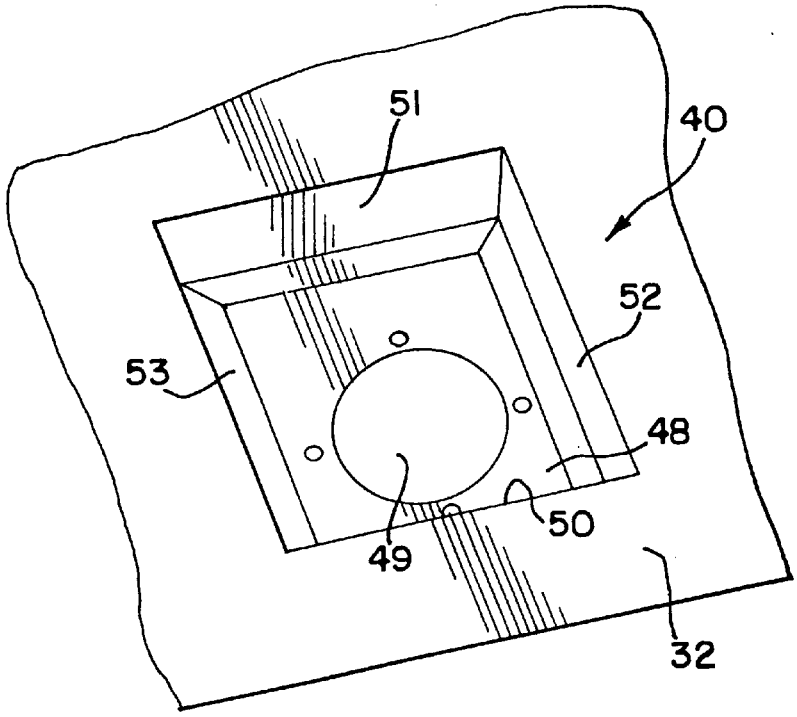
FIG. 4 is an enlarged view of the top port of the fireplace of FIGS. 2 and 3.

The present invention relates to a single fireplace construction that could be used in either a vertical venting configuration (i.e., in which the exhaust is directed away from the fireplace in a predominately upward direction) or a horizontal venting configuration (i.e., in which the exhaust is directed away from the fireplace predominately from the rear of the fireplace). FIG. 1 illustrates a gas-fueled fireplace in accordance with the preferred embodiment of the present invention. It should be noted that, although in the present invention, the fireplace is powered by a gaseous substance, the present invention may alternatively apply to other fireplaces, such as, for example, wood-burning fireplaces. FIGS. 2–6 show additional views and aspects of the gas-fueled fireplace in accordance with the present invention.

Referring to FIGS. 1–6, a gas fireplace 10 has a combustion chamber 11 defined by sidewalls 12 and 14, a rear wall 16 and top and bottom walls 13 and 15. Ceramic gas logs 18 are arranged over a burner assembly 19 in a conventional manner. A glass front door (not shown) would finish the combustion chamber 11 enclosure.

Surrounding the combustion chamber 11 is a fireplace housing. Air circulation pathways are formed within the fireplace housing in a conventional manner. One such pathway allows room air to be brought in from the bottom front of the fireplace housing and beneath the combustion chamber 11 (arrows 22). The room air is then directed along the rear of the combustion chamber 11 (arrows 23). Finally, the room air is directed along the top of the combustion chamber 11 (arrows 24) and back into the room. At this point, the room air has been heated due to the placement of the pathway air proximate to the heated combustion chamber 11.

In another pathway, combustion air (i.e., air entering the combustion chamber 11) is brought in from the exterior of the building through a concentric flue pipe assembly common to this type of fireplace. As will be described below, the combustion air can enter from one of two available ports. Once within the fireplace housing, the combustion air travels a pathway immediately outboard of the room air pathways. That is, the inboard side of the combustion air pathway includes the wall structure forming the outboard side of the room air pathway. This placement also aids in the heating of the room air contained within the room air pathways. Combustion air travels downward through the rear of the fireplace 10 (arrows 25), then into the combustion chamber 11 (arrow 26) through combustion chamber air inlets 28 formed in a bottom portion of the rear wall 16.

The fireplace housing has exterior sidewalls 30, 31, top wall 32, bottom wall 33 and rear wall 34. Space between the fireplace housing walls 30, 31, 32, 33, 34 and the adjacent inboard wall structure defining the combustion air flowpath may be preferably filled with fiberglass insulation.

A top port 40 and a rear port 41 are provided in the fireplace. As shown in FIGS. I and 4, these ports communicate with an outlet box 44 extending from the combustion chamber. Top port 40, for example, has a port bottom 48 with a circular hole 49 formed therein which connects with the outlet box 44. Sidewalls 50, 51, 52 and 53, preferably made with sheet metal, each with inwardly extending flanges, extend downward from top wall 32 of the fireplace housing 11 to define the sides of the top port 40. The bottom of this sidewall structure for the top port 40 is spaced above the port bottom 48, forming a space for outside air to enter the fireplace in the following manner.

Figure 5:
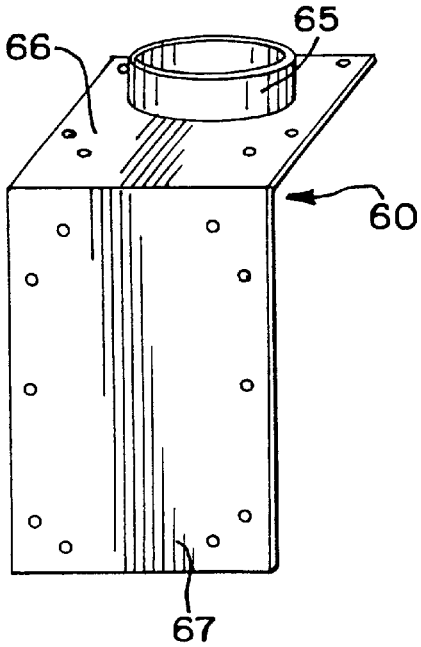
FIG. 5 is a perspective view of the air inlet pipe member of the vent pipe assembly.
Figure 6:
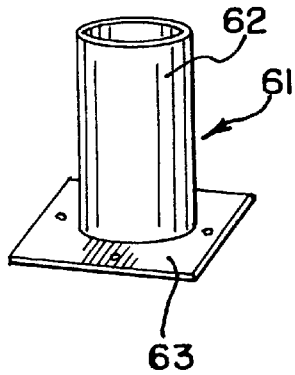
FIG. 6 is a perspective view of the air outlet pipe member of the vent pipe assembly.

A vent pipe assembly, as shown in detail with reference to FIGS. 5–6, includes an air inlet pipe member 60 and an air outlet pipe member 61. The vent pipe assembly is used to connect one of the above ports 40, 41 to conventional pipe ducting.

Air outlet pipe member 61 includes a tubular portion 62 and a plate portion 63. The plate portion 63 may preferably be fixed into place on one of the port bottoms 48. The plate portion 63 may be fixed into place by machine screws positioned through the screwholes shown in the drawings, or by any other presently known manner.

Air inlet pipe member 60 has a tubular collar portion 65, a port plate portion 66 and a cover plate portion 67. In addition to adding to the structure of the vent pipe assembly, the cover plate portion 67 also functions to close off the non-selected port, thus preventing the escape of any exhaust material through the non-selected port.

In operation, for example, if the top port 40 has been selected, the port plate portion 66 is attached to the top wall 32 of the fireplace housing, with the tubular collar portion 65 surrounding the tubular portion 62 of the air outlet pipe member 61 by sheet metal screws, for example. At this point, the cover plate portion 67 then overlies the back port 41, preventing the escape of any exhaust material from the combustion chamber 11 through the rear port 41. The cover plate portion 67 is likewise attached to the fireplace by, for example, sheet metal screws, or by any other presently known manner.

In a similar manner, the vent pipe assembly may be attached to the fireplace via the rear port 41, preventing the escape of any exhaust material from the combustion chamber 11 through the top port 40. In this case, for example, the port plate portion 66 is attached to the rear wall 34 of the fireplace housing, with the tubular collar portion 65 surrounding the tubular portion 62 of the air outlet pipe member 61 by sheet metal screws, for example. At this point, the cover plate portion 67 then overlies the top port 40, preventing the escape of any exhaust material from the combustion chamber 11 through the top port 40. The cover plate portion 67 is likewise attached to the fireplace by, for example, sheet metal screws or by any other presently known manner.

It should be appreciated that the embodiments described above are to be considered in all respects only illustrative and not restrictive. The scope of the invention is indicated by the following claims rather than by the foregoing description. All changes that come within the meaning and range of equivalents are to be embraced within their scope.

We claim:

1. A fireplace adapted for attachment to a flue pipe assembly including an exhaust pipe and a surrounding fresh air pipe, comprising:

an interior housing forming a combustion chamber;

a top wall, a rear wall and side walls defining an exterior housing about the combustion chamber;

a combustion air flowpath defined within the interior housing through which air for combustion is brought from outside the interior housing into the combustion chamber;

a top port formed in the top wall and a rear port formed in the rear wall, each of the top and rear ports including a first portion and a second portion, the first portion communicating with the combustion chamber, the second portion communicating with the combustion air flowpath; and a vent pipe assembly including an inlet air pipe member and an outlet air pipe member, the outlet air pipe member being connectable with a selected port at the first portion, the inlet air pipe member being connectable with the selected port at the second portion and including a plate portion extending therefrom which overlies and closes an unselected port, the vent pipe assembly being non-integral with the housing and being movable between the top port and the rear port.

2. The fireplace of claim 1, further comprising a room air flowpath defined within the housing through which air is brought from a room in which the fireplace is located to be heated.

3. The fireplace of claim 1, wherein the fireplace is adapted for burning a gaseous substance.

4. The fireplace of claim 1, wherein the fireplace is adapted for burning wood products.

5. The fireplace of claim 1, wherein the fireplace is a direct vent fireplace.

6. The fireplace of claim 1, wherein the inlet air pipe member is cylindrical in shape.

7. The fireplace of claim 1, wherein the outlet air pipe member is cylindrical in shape.

8. The fireplace of claim 1, wherein the inlet air pipe member and the outlet air pipe member form a concentric cylinder.

9. A fireplace including a vent pipe assembly, comprising:

an inlet air pipe member including an opening formed therein and a plate portion extending therefrom, the plate portion being positioned over an unselected port of the fireplace to prevent the escape of exhaust material through the unselected port; and an outlet air pipe member positioned within the opening of the inlet pipe member, the outlet pipe member being connectable with a selected port of the fireplace to allow the escape of exhaust material through the selected port.

10. The vent pipe assembly of claim 9, wherein the inlet air pipe member is cylindrical in shape.

11. The vent pipe assembly of claim 9, wherein the outlet air pipe member is cylindrical in shape.

12. A fireplace, comprising:

a selected port;

an unselected port; and a vent pipe assembly including an inlet air pipe member and an outlet air pipe member, each of the inlet and outlet air pipe members being connectable with the selected port, the inlet air pipe member including a plate portion extending therefrom which overlies and closes the unselected port, the vent pipe assembly being non-integral with the fireplace and being movable between the selected port and the unselected port.

13. The fireplace of claim 12, wherein the fireplace is adapted for burning a gaseous substance.

14. The fireplace of claim 12, wherein the fireplace is adapted for burning wood products.

15. The fireplace of claim 12, wherein the fireplace is a direct vent fireplace.

16. The fireplace of claim 12, wherein the selected port is positioned at a top end of the fireplace.

17. The fireplace of claim 12, wherein the selected port is positioned at a rear end of the fireplace.

18. The fireplace of claim 12, wherein the inlet air pipe member is cylindrical in shape.

19. The fireplace of claim 12, wherein the outlet air pipe member is cylindrical in shape.

20. The fireplace of claim 12, wherein the inlet air pipe member and the outlet air pipe member form a concentric cylinder.

* * * * *